US005978635A

United States Patent [19]

Azuma et al.

[11] Patent Number: 5,978,635

[45] Date of Patent: Nov. 2, 1999

[54] IMAGE DEVELOPING DEVICE USING A ONE-COMPONENT TONER

[75] Inventors: Nobuyuki Azuma, Ibaraki; Tadashi Iwamatsu, Nara; Hiroshi Tatsumi, Shiki-gun; Atsushi Inoue, Ikoma-gun; Masanori Yamada, Ikoma; Takayuki Yamanaka, Tenri, all of Japan

[73] Assignee: Sharp Kabushiki Kaisha, Osaka, Japan

[21] Appl. No.: 09/239,122

[22] Filed: Jan. 28, 1999

[30] Foreign Application Priority Data

Feb. 3, 1998 [JP] Japan ..... 10-21986

[51] Int. Cl.[6] ..... G03G 15/08

[52] U.S. Cl. ..... 399/283; 399/285

[58] Field of Search ..... 399/119, 264, 399/265, 270, 283, 285, 286; 118/652, 653; 428/40.9, 209

[56] References Cited

U.S. PATENT DOCUMENTS

| | | | |
|---|---|---|---|
| 4,866,480 | 9/1989 | Hosoya et al. . | |
| 4,930,438 | 6/1990 | Demizu et al. | 399/281 |
| 4,967,231 | 10/1990 | Hosoya et al. | 399/285 X |
| 5,104,707 | 4/1992 | Watanabe et al. | 428/40.9 |
| 5,287,150 | 2/1994 | Kinoshita et al. | 399/281 |
| 5,424,817 | 6/1995 | Imamiya et al. | 399/281 |
| 5,568,236 | 10/1996 | Toda et al. | 399/285 |

FOREIGN PATENT DOCUMENTS

| | | | |
|---|---|---|---|
| 607790 | 2/1985 | Japan | G03G 15/08 |
| 2191974 | 7/1990 | Japan | G03G 15/08 |
| 2557826 | 9/1996 | Japan | G03G 15/08 |

*Primary Examiner*—Robert Beatty
*Assistant Examiner*—Hoan Tran
*Attorney, Agent, or Firm*—Renner, Otto, Boisselle & Sklar

[57] ABSTRACT

An elastic member for pressing is provided in a prescribed location in an area where the developer carrier comes in contact with the discharging member, in order to bring the discharging member into contact with the developer carrier so that mechanical peeling of the residual developer on the developer carrier is not caused, and the discharging member is provided with a bias power supply for setting bias in a direction imparting to the discharging member a force for electrically drawing the residual developer on the developer carrier away from the developer carrier, and after thus reducing the electric adhesion of the residual developer to the developer carrier, the developer feed member removes the residual developer on the developer carrier in the vicinity of disjunction area or in the contact area of the developer carrier and the developer feed member, thereafter applies new developer in a developer container to the developer carrier in the vicinity of approaching area or in the contact-starting area of the developer carrier and the developer feed member.

9 Claims, 7 Drawing Sheets

IMAGE DEVELOPING DEVICE USING A ONE-COMPONENT TONER

BACKGROUND OF THE INVENTION (1) Field of the Invention

The present invention relates to a developing device using one-component toner, more specifically, relates to a developing device used for an image forming device such as copying machines using electrophotography, printers and electrostatic recording devices.

(2) Description of the Related Art

The developing device using one-component toner is easy to reduce the size and easy to handle, but there is a problem in transferring and charging the toner and making the toner uniformly thin. A general developing device will now be described with reference to FIG. 1.

As shown in FIG. 1, an electrostatic image is formed on the surface of a photosensitive drum 51, which is an electrostatic latent image carrier, by means of a latent image-forming means (not shown). A developing roller 100 is disposed in a position opposite to the photosensitive drum 51 as a developer carrier, and on the surface of the developing roller 100, toner 2 which is the developer is adhered. The development is carried out by adhering the toner 2 to the photosensitive drum 51 to visualize the electrostatic image. The charged toner 2 is formed in a thin layer on the developing roller 100.

As for the means for forming toner in a thin layer, the toner 2 is first supplied and adhered on the developing roller 100 by a toner feed roller 200 which is a developer feed member brought into contact with the developing roller 100 and is connected to a bias power supply 210 for feeding toner. Thereafter, the toner 2 on the developing roller 100 is formed uniformly in a thin layer by a blade 300 which is a developer regulating member, as the developing roller 100 rotates. Furthermore, voltage for the developing bias is impressed to the developing roller 100 by a power supply 110 and blade bias voltage is impressed to the blade 300 by a power supply 390.

With such a developing device 1*b* using one-component developer, however, when the residual toner adhered to the developing roller 100 is not removed after the development, the developing pattern formed by the residual toner remains until the next development, resulting in a memory image. To solve this problem, a Mylar sheet 430 (a residual toner removing member) abutting to the developing roller 100 after the development is newly provided to scratch the residual toner on the developing roller 100.

With the developing device using conventional non-magnetic developer (hereinafter referred to as "toner"), as a method for supplying the toner, there have been disclosed many methods, such as the one using an elastic foamed body which is disclosed in Japanese Unexamined Patent Publication No. Hei 2-191974. The one using the elastic foamed body as the method for supplying the toner is capable of supplying the toner to the developer carrier (hereinafter referred to as a "developing roller"), but it has been difficult to remove the residual toner on the developing roller which passed through the developing zone. In particular, when the supply voltage having the same polarity as the charging polarity of the toner is impressed in order to supply toner sufficiently and stably, removal of the residual toner on the developing roller becomes more difficult. As a result, in the toner layer on the developing roller, toner which was not consumed in the developing zone and toner newly supplied by the developing roller mingle together to deteriorate the developing properties and cause a development history (development unevenness).

Therefore, as disclosed in Japanese Patent Publication No. Sho 60-7790, there is a method in which a roller for recovering the residual toner from the developing roller is provided in a prescribed location, and bias voltage having the opposite polarity to the charged polarity of the toner is impressed on the recovering roller to remove the residual toner on the developing roller after it passed through the developing zone. With this method, however, a roller for recovering the toner is separately required, and the cost increases.

Moreover, as disclosed in Japanese Patent No. 2557826 (issued in 1996), there is a method in which a thin plate having elasticity is brought into contact with the developing roller to remove the residual toner on the developing roller. Moreover, there is another method in which a thin plate is brought into contact with the developing roller and bias voltage is impressed to the thin plate to remove the residual toner on the developing roller.

With these methods, when the residual toner on the developing roller is removed, it is necessary to bring the toner removing member into deep contact with the developing roller. Furthermore, in the case of removing the residual toner on the developing roller electrically, the discharging effect is increased by pressing the toner removing member into deep contact with the developing roller and enlarging the contact area.

As a result, a mechanical stress is applied to the residual toner on the developing roller, and the toner is easily deteriorated, thus deterioration of the developing properties, such as filming of the toner on the surface of the developing roller may be caused.

On the other hand, with the technique disclosed in Japanese Unexamined Patent Publication No. Hei 2-191974, it is described therein that the cell density of the elastic foamed body is preferably from 10 cells per 25 mm to 200 cells per 25 mm, and cells are brought into contact with each other so that the contact depth is from 0.5 mm to 2 mm and the contact width is from 0.2 mm to 5 mm, or cells are closely arranged so that the distance between the both surfaces is not larger than 2 mm. However, the above-mentioned cell density corresponds to the cell density of almost all foamed elastic body, and there may be a problem occurred at the time of actual use. For example, if the cell density is low, the toner easily penetrates into the foamed cell of the elastic foamed body to make the elastic foamed body hard. As a result, increase of the driving torque of the feed roller or decrease of the volume of toner transferred by the feed roller is caused. On the contrary, if the cell density is high, the toner cannot easily penetrate into the foamed cell of the elastic foamed body, but the volume of toner transferred by the feed roller decreases. As a result, the density necessary for development cannot be obtained, and since the hardness of the elastic foamed body itself is high, the torque increases, the contact pressure between the developing roller and the feed roller becomes high, and the toner is subjected to the mechanical stress and becomes easily deteriorated.

Furthermore, since the contact conditions has a wide range, the feed properties differ largely. For example, if the contact depth is large, the contact pressure between the developing roller and the feed roller becomes high, the driving torque of both rollers increases, and the toner is subjected to the mechanical stress and easily deteriorated. On the contrary, if the contact depth is small, the capability of the feed roller to apply the toner to the developing roller decreases, and the feed roller cannot feed the toner sufficiently. In addition, the accuracy of the outer diameter of the feed roller is required, but the preparation thereof with the elastic foamed body is difficult.

Furthermore, with a feeding method using an elastic foamed body as a feed member, the developing roller and the feed member are brought into contact with each other. In this case, the developing roller having hardness higher than that of the feed roller is normally used. For example, as a material of the developing roller, a metal sleeve or an elastic solid rubber is often used. Therefore, in the contact area of the developing roller and the feed roller, modified feed rollers using an elastic foamed body having hardness lower than that of the developing roller accounts for the majority thereof, and the state of the contact pressure between the developing roller and the feed roller is mostly determined by the hardness of the feed roller. That is to say, even if the contact depth of the developing roller and the feed roller is the same amount, if the hardness of the feed roller is high, the pressure in the contact area of the developing roller and the feed roller increases, on the contrary, if the hardness of the feed roller is low, the pressure in the contact area decreases.

Furthermore, with a toner feeding method using an elastic foamed body, toner adhered on the surface of the feed roller and toner infiltrating shallowly into the inside of cells are transferred to the surface of the developing roller, as the feed roller rotates. The toner which has reached the contact area of the developing roller and the feed roller is frictionally charged and moves to the surface of the developing roller. At that time, however, the toner transferred to the surface of the developing roller is only the toner existing close to the outermost layer on the surface of the feed roller, and the quantity of toner mechanically applied to the developing roller decreases, hence poor supply of toner is easily caused on the developing roller. At the time of developing solid black, sufficient image density cannot be obtained.

Therefore, when the followability of the image density at the time of printing solid black is kept during development, if supply bias having the same polarity as the charging polarity of the toner is applied to the toner feed roller in order to feed toner sufficiently and stably, the effect of discharging member obtained by mechanically removing the residual toner on the developing roller with the feed roller is hardly obtained. That is to say, the electric adhesion of the residual toner with the developing roller after passing through the developing zone is decreased by the discharging member, but by applying the supply bias to the feed roller, the residual toner removed by the mechanical force of the feed roller adheres again on the surface of the developing roller due to the electric field in the feeding direction of the toner, formed between the developing roller and the feed roller, in the vicinity of disjunction or in the contact area of the feed roller and the developing roller. As a result, there is a possibility to cause a difference in the charge quantity or a difference in the adhesion quantity per unit area between the residual toner on the developing roller and the newly supplied toner, and it appears as density unevenness (development history) on the output image.

SUMMARY OF THE INVENTION

It is, therefore, an object of the present invention to provide a developing device which can carry a toner to a developing zone so that there is no development history on a developing roller.

It is another object of the present invention to provide a developing device which can increase chances for discharging a toner in the contact area between the developing roller and a discharging member, and can be set so that the toner in the contact area is not mechanically removed.

It is a further object of the present invention to provide a developing device which can maintain the capability of supplying a toner stably to a developing roller and the capability of removing the residual toner on the developing roller regardless of the lapse of time.

It is still another object of the present invention to provide a developing device where a developer feed member has compatibly both capabilities of supplying a developer to and removing a residual developer from a developer carrier.

It is a still further object of the present invention to provide a developing device which can obtain sufficient image density even at the time of developing solid black.

To attain the above-mentioned objects, the gist of the present invention has the following constructon.

The first gist of the present invention is an electrostatic latent image developing device comprising: a developer carrier for supporting and carrying one-component developer on the surface thereof; a developer feed member for abutting against the developer carrier and feeding the developer to the developer carrier; and a discharging member for discharging the developer on the developer carrier after development, in which residual developer on the developer carrier is removed, wherein an elastic member for pressing is provided in a prescribed location in an area where the developer carrier comes in contact with the discharging member, in order to bring the discharging member into contact with the developer carrier so that mechanical peeling of the residual developer on the developer carrier is not caused, the discharging member is provided with a bias power supply for setting bias in a direction imparting to the discharging member a force for electrically drawing the residual developer on the developer carrier away from the developer carrier, and after thus reducing the electric adhesion of the residual developer to the developer carrier, the developer feed member removes the residual developer on the developer carrier in the vicinity of disjunction area or in the contact area of the developer carrier and the developer feed member, thereafter applies new developer in a developer container to the developer carrier in the vicinity of approaching area or in the contact-starting area of the developer carrier and the developer feed member.

The second gist of the present invention is a developing device according to the first gist, wherein the elastic member for pressing has the Asker F hardness of not higher than 70°.

The third gist of the present invention is a developing device according to the first gist, wherein the developer feed member comprises an elastic foamed body having the number of foaming cells of from 80/in. to 140/in., the developer feed member abuts against the developer carrier with a contact depth of from 0.5 mm to 1 mm, feeds the developer to the developer carrier in proximity to or in the contact area with the developer carrier, and removes the residual toner on the developer carrier in the disjunction or contact area thereof.

The fourth gist of the present invention is a developing device according to the first gist, wherein the developer feed member comprises an elastic foamed body having the Asker F hardness of 60° to the Asker C hardness of 30°.

The fifth gist of the present invention is a developing device according to the first gist, wherein the developer feed member is an electroconductive elastic foamed body having a resistance of from $10^4$ to $10^7$ Ω, and bias voltage of the same polarity as the charging polarity of the developer on the developer carrier is applied to the developer feed member.

The sixth gist of the present invention is a developing device according to the first gist, wherein the following formula is satisfied:

$$|Vc|-50 \leqq |Vt| \leqq |Vc|+100 \text{ (V)}$$

with regard to the bias voltage Vt (V) impressed to the developer feed member and the bias voltage Vc (V) impressed to the discharging member.

The seventh gist of the present invention is a developing device according to the first gist, wherein the discharging member is a thin plate-like member of an electroconductive elastic body, and bias voltage having a polarity opposite to the charging polarity of the developer is impressed to the discharging member.

The eighth gist of the present invention is a developing device according to the seventh gist, wherein the discharging member in the thin plate-like member comprises polycarbonate, polybutyl terephthalate, and has carbon black a resistance of from $10^3$ to $10^6$ Ω.

The ninth gist of the present invention is a developing device according to the first gist, wherein the discharging member and the developer carrier abut against each other in the contact area in the axial direction wider than the developer carrying area on the developer carrier.

Herein after a developer carrier, a developer, a developer feed member, a residual developer, and elastic member are also called "developing roller", "toner", "feed roller", "residual toner" and "elastic foamed body", respectively.

According to the first gist, it becomes possible to provide an elastic foamed body between the surface opposite to the contacting surface of the thin plate-like discharging member with the developing roller, and the developer container, for example, in a contact area of the thin plate-like discharging member and the developing roller, so that the abutting force between the developing roller and the thin-plate elastic body which is a discharging member can be reduced and the contact area between the developing roller and the discharging member can be sufficiently secured, to reduce the abutting force between the developing roller and the thin plate-like discharging member and to enlarge the contact area between them. Hence, electric discharging is performed in the contact area of the developing roller and the discharging member, without mechanically peeling off the residual toner on the developing roller, and after reducing the electric attraction working between the developing roller and the residual toner, the residual toner on the developing roller is mechanically removed in the contact area of the feed roller and the developing roller, or in the vicinity of disjunction of them, and the developing roller is provided with new toner in the area where the developing roller is close to the feed roller or in the contact area therewith. As a result, toner without having any development history onto the developing roller can be transferred and to the developing zone.

According to the second gist, after one end of the ends of the thin-plate discharging member is fixed to the developing container, the free end thereof is brought into contact with the developing roller, and an elastic foamed body is provided on the opposite side of the contact surface of the discharging member and the developing roller in the contact area, and the sponge hardness of the elastic foamed body is set to be not higher than 70° as measured by the Asker F hardness, thereby the contact area between the developing roller and the thin-plate discharging member can the enlarged, without increasing the contact pressure between the developing roller and the thin-plate discharging member. As a result, a chance of discharging the toner in the contact area between the developing roller and the discharging member increases, without mechanically removing the toner in the contact area.

According to the third gist of the present invention, the foamed cell density is limited to a range of from 80 cells per in. to 140 cells per in., and the contact depth of the developing roller and the feed roller is limited to a range of from 0.5 mm to 1 mm, thereby stable feed capability and removal capability of the residual toner on the developing roller can be maintained for a long period of time.

According to the fourth gist, by limiting the hardness of the elastic foamed body used for the feed roller in the range of from the Asker F hardness of 60° to the Asker C hardness of 30°, the residual toner on the developing roller can be removed, and at the same time, new toner can be supplied onto the surface of the developing roller. That is, the removal capability and the feed capability can be compatible in the feed roller.

According to the fifth gist, by using an electriconductive elastic foamed body as the developer feed member, limiting the resistance value thereof in a range of from $10^4$ to $10^7$ Ω, and impressing bias voltage of the same polarity as the charging polarity of the toner on the developing roller to the developer feed roller, the above-mentioned bias voltage is impressed in the contact area of the developing roller and the feed roller, an electric field is formed in the moving direction of the charged toner toward between the developing roller and the feed roller. As a result, it becomes possible to apply the frictionally charged toner sufficiently onto the developing roller, in the vicinity of the contact area of the developing roller and the feed roller, hence sufficient image density can be obtained even at the time of developing solid black.

According to the sixth gist of the present invention, by deciding the conditions of impressing the supply bias voltage and the discharging bias voltage within the range of the above-mentioned formula, with regard to the discharging bias applied to the discharging member and the supply bias for sufficiently supplying the toner to the developing roller, stable toner supply to the developing roller from which the residual toner has been removed can be realized, and the effect of removing the residual toner on the developing roller and the feed roller by discharging them after passing through the developing zone can be improved, without causing a development history.

According to the seventh gist of the present invention, by using an electriconductive material for the thin-plate discharging member, discharging of the residual toner on the developing roller can be easily performed.

According to the eighth gist of the present invention, the discharging member in a thin plate-like form comprises polycarbonate, polybutyl terephthalate, and carbon black, thereby the discharging member having electroconductivity and excellent wear resistance can be used for the elastic thin plate-like member.

According to the ninth gist of the present invention, the length of the discharging member in the axial direction of the developing roller is made longer than the area where the developing roller carries toner to the electrostatic latent image, in other word, the adhesion area of the toner which adheres in the axial direction of the developing roller, thereby the discharging member can be brought into contact with the developing roller so that the discharging effect can be obtained with respect to the entire toner on the developing roller.

DESCRIPTION OF THE PREFERRED EMBODIMENTS

The embodiments of the present invention will now be described with reference to the accompanying drawings.

Figure 2:
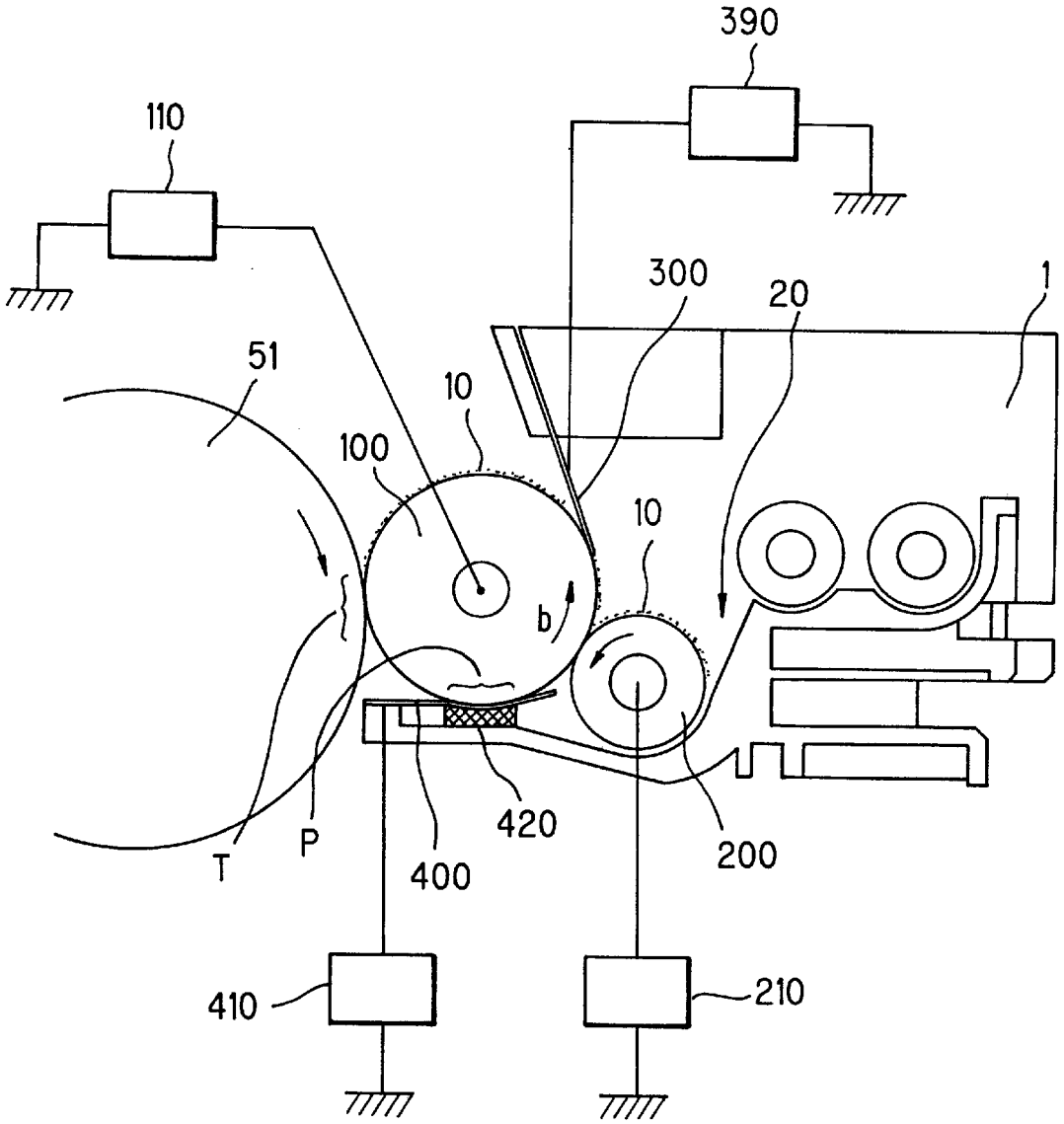
FIG. 2 is a schematic diagram showing the whole developing device according to an embodiment of the present invention.

FIG. 2 is a schematic sectional view showing diagram of a reversal developing device using negatively charged non-magnetic one component toner according to an embodiment of the present invention, wherein a developing device (developing unit) 1 is so disposed as to oppose a photosensitive drum (OPC drum) 51 on which an electrostatic latent image is formed by a latent image forming means (not shown).

The developing device 1 has a developing roller 100 which is a developer carrier, a toner feed roller 200 which is a developer feed member, a toner layer restraining blade 300 which is a developer restraining member, a developer container 20 for accommodating toner 10, and respective power supplies (a power supply 110 for developing bias which applies developing bias voltage to the developing roller 100, a power supply 210 for toner supply bias which supplies bias power to the toner feed roller 200, and a power supply 390 for blade bias which applies blade bias voltage to the blade 300).

In the developing device 1, the toner feed roller 200 is pressed to come in contact with the developing roller 100, and the rotation direction of the toner feed roller 200 is so set that it is in the opposite direction to the rotation (proceeding) direction of the developing roller 100 at the portion where it faces the developing roller 100. Therefore, the developing roller 100 and the toner feed roller 200 slide in contact with each other at the opposing portion.

The toner feed roller 200 is formed using the same material as that of the developing roller 100, and it is possible to adjust the electric resistance by using a resistance-adjusting material similar to that for the developing roller 100. To further increase the elasticity of the toner feed roller 200, a foamed material is used for the toner feed roller 200, and the amount of the foaming agent used to prepare the feed roller 200 is larger than the amount used for the developing roller 100. Voltage is applied to the toner feed roller 200 from the bias power supply 210, and in general, large bias voltage is applied to the feed roller 200 in the direction pushing the toner toward the developing roller 100, for example, if an negative toner is used, large bias voltage is applied to the toner feed roller 200 on the negative electrode side. The toner 10 supplied to the developing roller 100 by the toner feed roller 200 is transferred to a position where the blade 300 which is a member for restraining the thickness of the toner layer abuts against the developing roller 100 with the rotation of the developing roller 100.

The blade 300 made of a plate-like metal material is pressed to the developing roller 100 at the inner portion near the tip thereof. The toner 10 supplied to the developing roller 100 is restrained to a predetermined charge quantity and thickness depending upon a predetermined set pressure and set position of the blade 300, transferred to the developing zone (a portion T facing the photosensitive material) and comes into the developing process. Furthermore, voltage is impressed to the blade 300 from the bias power supply 390, and there are cases where large bias voltage is impressed to the blade 300 in the direction pressing the toner 10 to the developing roller 100, for example, if an negative toner is used, on tile negative electrode side, and where bias voltage is impressed so that the blade has the same potential as that of the developing roller 100.

For example, with this embodiment, an negative toner (negatively charged toner) is used as the toner, and the surface potential of the toner layer is from about −30 (V) to about −50 (V), though it depends upon the kind of toner (the difference of the saturated charge quantity of the toner).

With regard to the discharging bias and the supply bias, respective effects can be obtained by having a potential difference with the developing roller 100. Therefore, when −500 (V) of the developing bias is applied between the photosensitive material 51 and the developing roller 100, other bias conditions will be as described below. That is, Discharging bias=−300 (V) (potential difference with the developing roller=+200 (V)), Supply bias=−700 (V) (potential difference with the developing roller=−200 (V)), and blade bias=−600 (V) (potential difference with the developing roller=−100 (V)).

The undeveloped toner on the developing roller 100 which has not been used in the developing process returns to the developing device 1 with the rotation of the developing roller 100. However, the charging force is removed by a toner discharging device/means on the developing roller 100 installed after the developing zone and before the feed roller 200, and thereby, the undeveloped toner is peeled and recovered to a hopper by pressing at the entrance of the feed roller 200 and reused.

The blade 300 used for forming the toner layer is phosphor bronze plate having a plate thickness of 0.1 mm, and abuts against the developing roller 100 at about 30 gf/cm. As the blade material, stainless, copper, brass or the like may be used. It is also possible to apply a material contributing to the toner charging and having excellent wear resistance on the blade 300, and bring it into contact with the developing roller.

The toner 10 is a non-magnetic one component type, and a negatively charged toner having a composition of 80 to 90 parts by weight of styrene-acrylic copolymer, 5 to 10 parts by weight of carbon black, 0.5 to 1.5 parts by weight of $SiO_2$ as an externally added agent, and 0 to 5 parts by weight of a charge control agent, and having an average particle size of from 5 to 10 μm is preferably used. In addition, the toner may be a positively charged toner, and it is a matter of course that the toner can be used not only as a black toner for monochrome copying machines and printers, but also as a color toner for color copying machines and printers.

Moreover, the non-magnetic one component toner 10 is not limited to the above-mentioned composition, but the composition as shown below may be used for the present invention.

As a thermoplastic resin which is the main resin, there can be mentioned polystyrene, polyethylene, polyester, low-molecular weight polypropylene, epoxy resin, polyamide, polyvinyl butyral or the like, other than styrene-acrylic copolymer.

As a coloring agent, there can be mentioned, other than carbon black as mentioned above, furnace black, nigrosine-type dyes, and metallized dyes and the like, and for the color toner, there can be mentioned yellow-coloring agents such as benzidine-type yellow pigment, phorone Yellow, acetoacetic acid anilide type non-soluble azo pigments, monoazo pigments and azomethine pigments and the like, magenta coloring agents such as xanthene-type magenta dyes, phosphotungsten molybdate lake pigments, anthraquinone dyes, coloring materials comprising a xanthene dye and an organic carboxylic acid, thioindigo, naphthol-type insoluble azo pigments and the like, and cyan coloring agents such as copper phthalocyanine pigments and the like.

As the externally added agents, there can be mentioned, other than $SiO_2$ as mentioned above, colloidal silica, titanium oxide, alumina, zinc stearate, polyvinylidene fluoride, and mixtures thereof.

As the charge control agent, there can be used azo-type metallized dyes, organic acid metal complex, chlorinated paraffin and the like for negatively charged toners, and nigrosine-type dyes, fatty acid metal salt, amines, quarternary ammonium salts and the like for positively charged toners.

Furthermore, as the developing roller 100, there can be used an electroconductive elastic developing roller of 27 mm in diameter (Db), composed of an electroconductive urethane rubber containing an electric conduction imparting agent such as carbon black and the like and having a volume resistivity of about $10^7$ Ωcm and JIS-A hardness of from 60° to 70°, and the surface roughness $R_z$ of the developing roller being from 3 to 6 μm (according to JISB-0601). The developing roller 100 rotates at a peripheral speed Vb of 200 mm/s in the direction of an arrow b in the figure, and developing bias voltage $E_1$ of −500 (V) is impressed to the developing roller 100 via a stainless shaft having a diameter Ds of 10 mm.

The toner feed roller 200 is obtained by forming an elastic foamed body having a foamed cell density of from 80 cells per in. to 140 cells per in., and Asker F hardness of 60° to Asker C hardness of 30° in a form of roller onto a electroconductive shaft made of metals such as stainless. Asker C hardness is measured in accordance with JIS S 6050 (spring type durometer). Asker F hardness is measured by using a hardness tester (manufactured by KOBUNSHI KEIKI CO., LTD, in Japan) according to procedure of JIS S 6050 under the following particular conditions that the pressing rod is a cylinder type of 25.2 mm in diameter, the spring load is 55 g at 0° and 455 g at 100°, and the pressing surface size and shape is a circle of 80 mm in diameter. The toner feed roller 200 comes in contact with the developing roller 100 with a contact depth of from 0.5 to 1 mm.

The discharging member 400 is an electroconductive thin-plate elastic body, and bias voltage of a polarity opposite to the charging polarity of the developer is impressed thereto by a power supply 410 for discharging bias. The discharging bias member 400 contains carbon black in a thin plate-like member made by mixing, for example, polycarbonate and polybutyl terephthalate, and the resistance value thereof can be set to be $10^3$ to $10^6$ Ω.

One end of the discharging member 400 is bonded to a part of the developing device 1, and the other end thereof is free and abuts against the developing roller 100. In the contact area P between the developing roller 100 and the discharging member 400, an elastic member for abutment 420 is provided in such a manner that it abuts on the back face of the discharging member 400.

The elastic member for abutment 420 is prepared by using a sponge material having Asker F hardness of 50°, and having a penetration quantity of about 0.3 mm in the contact area, and the contact width between the discharging member 400 and the developing roller 100 in the peripheral direction is set to be 2 mm.

That is to say, if the hardness of the elastic member for abutment 420 becomes high, the contact pressure between the developing roller 100 and the discharging member 400 becomes high, resulting in an effect of mechanical peeling with respect to the residual toner 10 on the developing roller 100. As a result, the toner 10 scratched on the surface of the discharging member 400 accumulates, causing spilling and fixation of toner. Therefore, to obtain only the discharging effect without mechanical scratching effect, the adhered quantity of the toner 10 on the surface of the discharging member 400 was visually confirmed by changing the sponge hardness of the elastic member for abutment 420, and as a result, it was found that the adhered quantity decreased dramatically with the sponge hardness of not higher than 70° as measured by Asker F hardness.

To ascertain the presence or absence of the development history (development memory) and the effect of scratching the residual toner on the developing roller by the toner feed roller after the discharging, with the developing device according to this embodiment, the following experiment was conducted for evaluation.

Figure 3A:
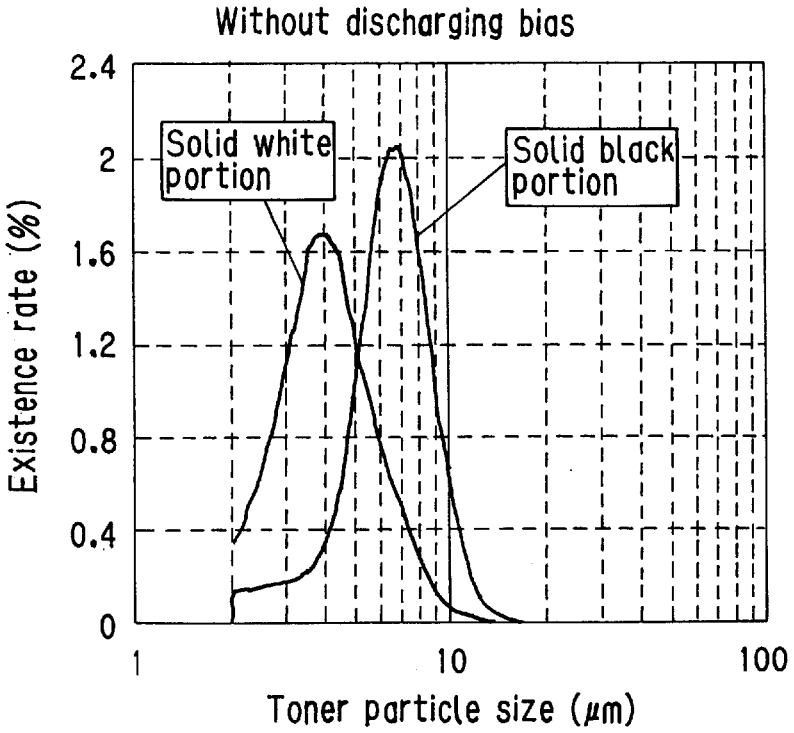
FIGS. 3A and 3B are graphs showing examples of discharging effects of a discharging member according to the first embodiment.
Figure 3B:
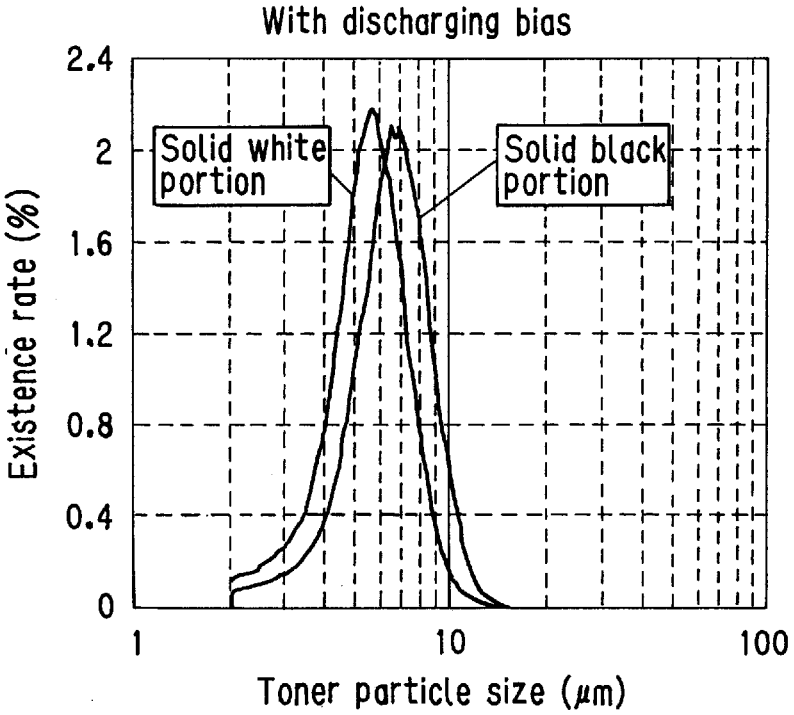

FIGS. 3A, 3B shows the evaluation results.

As a test image, a manuscript in which a solid white portion and a solid black portion exist half-and-half in the longitudinal direction of an A3 paper is prepared and the test image is printed for 10 sheets of paper continuously. At this time, since the toner on the developing roller 100 has been consumed for every printing in the area of the solid black portion, and new toner 10 has been supplied by the feed roller 200, the particle size distribution of the toner 10 is nearly constant. In the area of the solid white portion, however, the toner 10 is not consumed and passes through the discharging member 400 to return to the feed roller 200. At this time, if the scratching effect after discharging is low, toner having a small particle size which passes easily through the contact area between the feed roller 200 and the developing roller 100, among residual toner on the developing roller 100, is again transferred to the developing zone. Accordingly, it can be seen that as the toner particle size distribution in the solid white area approximates to that in the solid black area, larger scratching effect in the contact area of the feed roller 200 and the developing roller 100 is obtained.

Therefore, after the test image was printed for 10 sheets of paper continuously, the toner 10 on the developing roller 100 was extracted to measure the toner particle size distribution in the solid white portion and the toner particle size distribution in the solid black portion with a Coulter counter.

Figure 1:
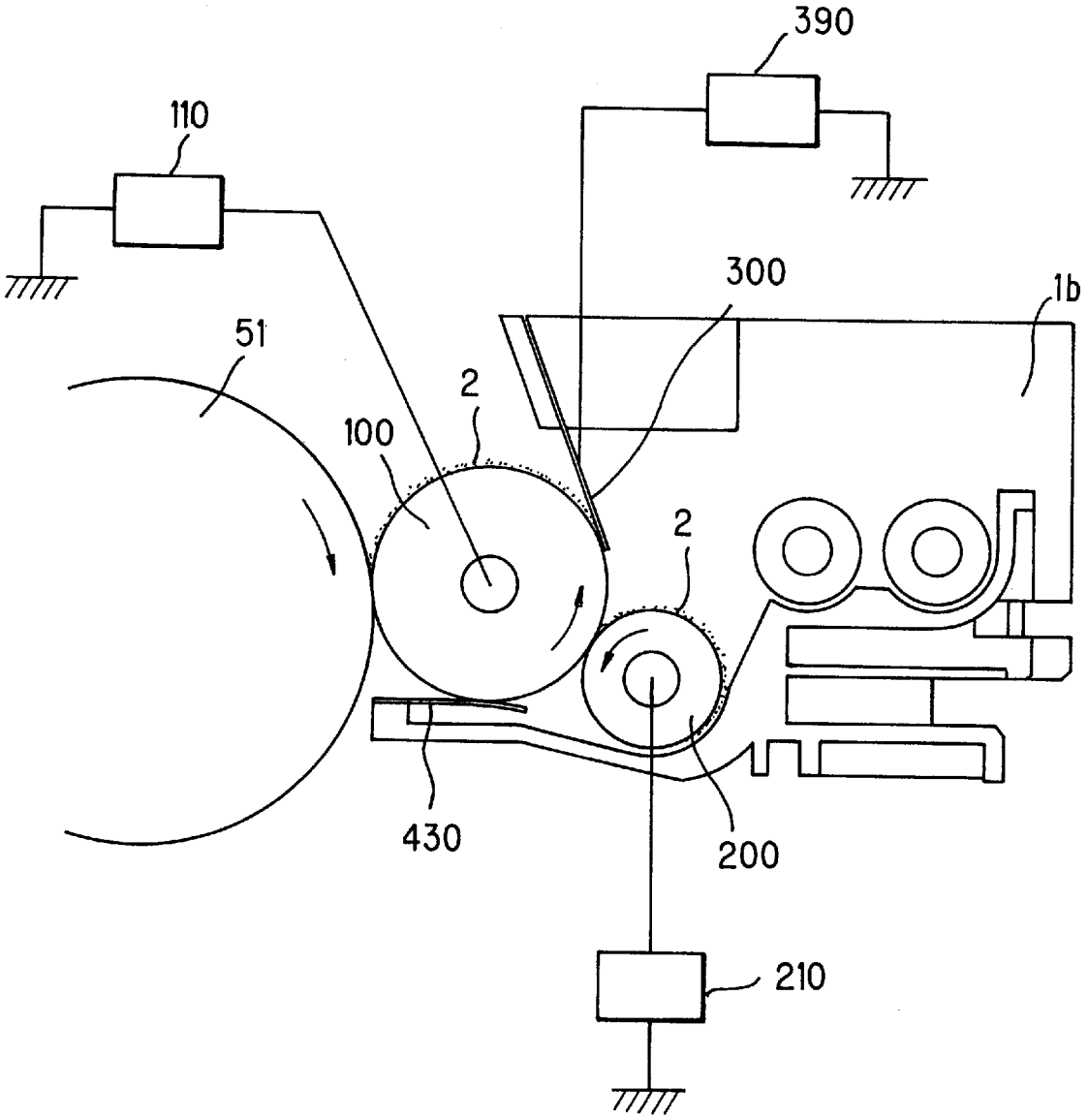
FIG. 1 PRIOR ART
FIG. 1 is a diagram of a conventional developing device.

Then, the similar experiment was conducted using a conventional developing device shown in FIG. 1, for comparison of the particle size distribution. With the conventional developing device, a Mylar sheet was attached for preventing the toner from leaking from a lower part of an opening in the developing unit onto the front face.

As for the bias conditions used in this study, the discharging bias Ec of +200 (V) and the supply bias of −200 (V) (with respect to the potential of the developing roller) were applied respectively to respective members.

As shown in FIG. 3A and FIG. 3B, with the developing device of this embodiment (with discharging bias in FIG. 3B), the difference in the toner particle size distribution between the solid white portion and the solid black portion is small. On the other hand, with the developing device using a conventional Mylar sheet (without discharging bias in FIG. 3A), it is seen that the difference in the toner particle size distribution between the solid white portion and the solid black portion is large.

Therefore, with the developing devices of this embodiment, the toner discharged by the discharging member 400 is scratched by the feed roller 200 and new toner 10 is applied to the developing roller 100. Moreover, when the existence of the development memory was ascertained using respective developing devices, with the developing device of this embodiment having a discharging member, development memory was not caused. On the contrary, with the developing device using a conventional Mylar sheet, development memory was caused in all test images.

The second embodiment will now be described.

The contact depth of the toner feed roller 200 and the developing roller 100, and the feed capability and removal capability of the toner feed roller 200 will be described. With regard to the feed capability of the toner feed roller 200 when the physical property value of the sponge was quite the same and the contact depth was different, an experiment was conducted in a manner described below.

Using a developing device 1 having the same construction as in the first embodiment, the developing device was stopped after the developing roller 100 conducted development of solid black on the photosensitive material (OPC drum) 51 for two rounds, and the quantity of toner adhered on the photosensitive material 51 was measured for every round.

In this case, the following method was used for measurement of the adhered quantity.

The toner on the photosensitive material 51 is peeled off from the photosensitive material 51 by using a suction device (not shown) having a nozzle. The nozzle of the suction device is provided with a filter for gathering the sucked toner, and the sucked toner can be received in the nozzle.

Therefore, the peeled quantity of toner can be obtained by subtracting the weight of the nozzle before sucking the toner from the weight of the nozzle after suction.

Furthermore, the toner quantity per unit area can be obtained by measuring the peeled area on the developing roller. As experiment conditions, supply bias of −700 (V), discharging bias of −500 (V) (the same potential as the developing roller), and developing bias of −500 () were used, and the toner feed roller 200 is a sponge roller comprising an electroconductive urethane sponge material having a cell density of 80/in., resistance of $10^5$ (Ω), and sponge hardness of 68° as measured by Asker F hardness.

Figure 4:
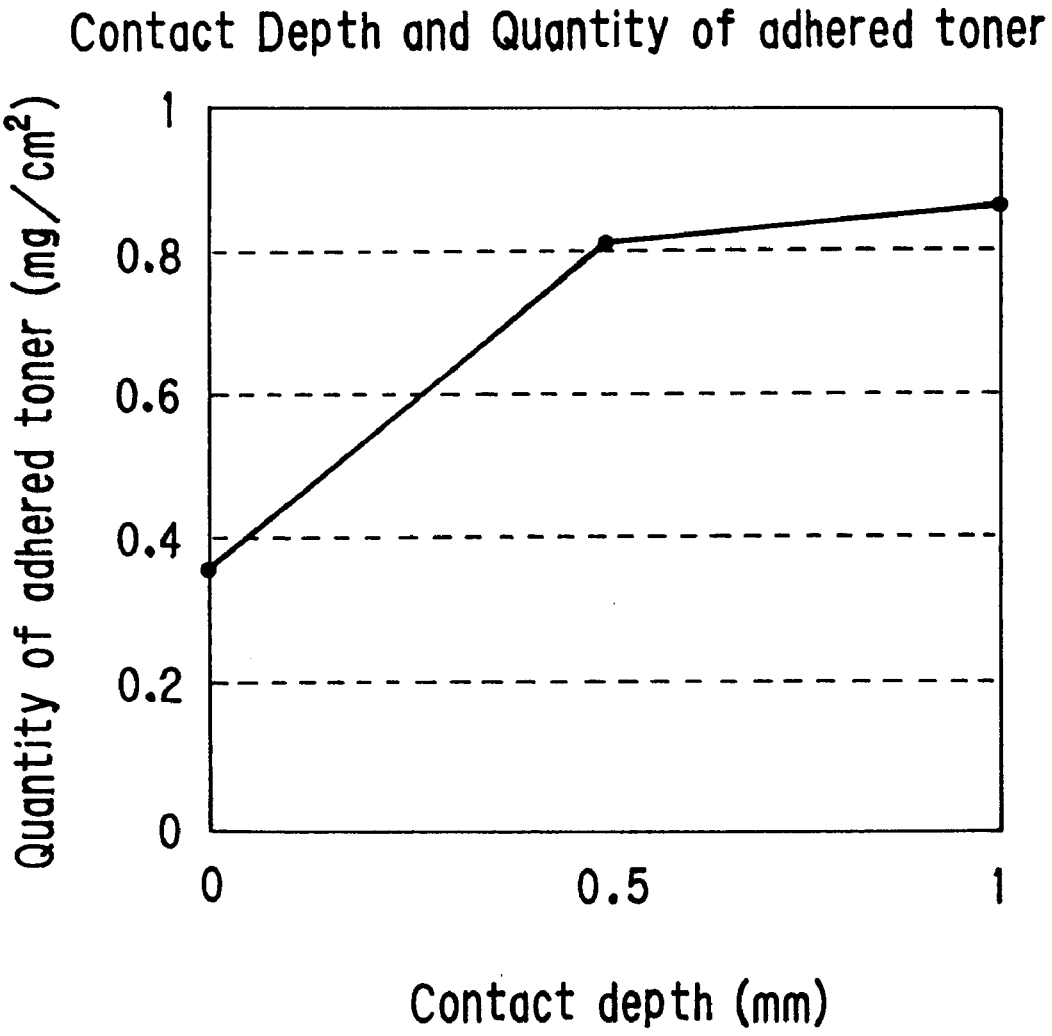
FIG. 4 is a graph showing an example of relationship between the contact depth of the developing roller and the feed roller and the adhered amount of toner on a photosensitive drum according to the second embodiment.

The experiment result is shown in FIG. 4.

As seen from FIG. 4, it is necessary to set the contact depth between the developing roller 100 and the feed roller 200 to be 0.5 mm or more in order to secure the followability of toner feed.

Furthermore, the removal capability of the toner feed roller 200 in the case where the physical property value of the sponge is quite the same and only the contact depth is different will be evaluated in the following experiment.

In this case, as in the first embodiment, the evaluation is performed according to the difference in the particle size distribution of the toner on the developing roller 100. In addition, to confirm the toner removal capability of only the feed roller 200, the evaluation was performed without applying discharging bias. The experiment results are shown in FIG. 5A and FIG. 5B.

Figure 5A:
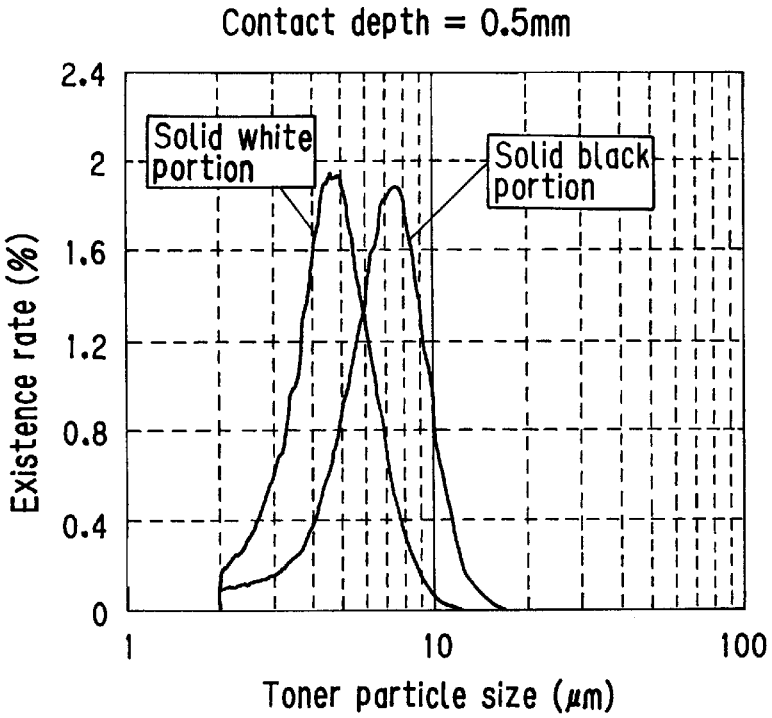
FIGS. 5A and 5B are graphs showing examples of the contact depth of the developing roller and the feed roller and the toner scratching effects on the developing roller according to the second embodiment.
Figure 5B:
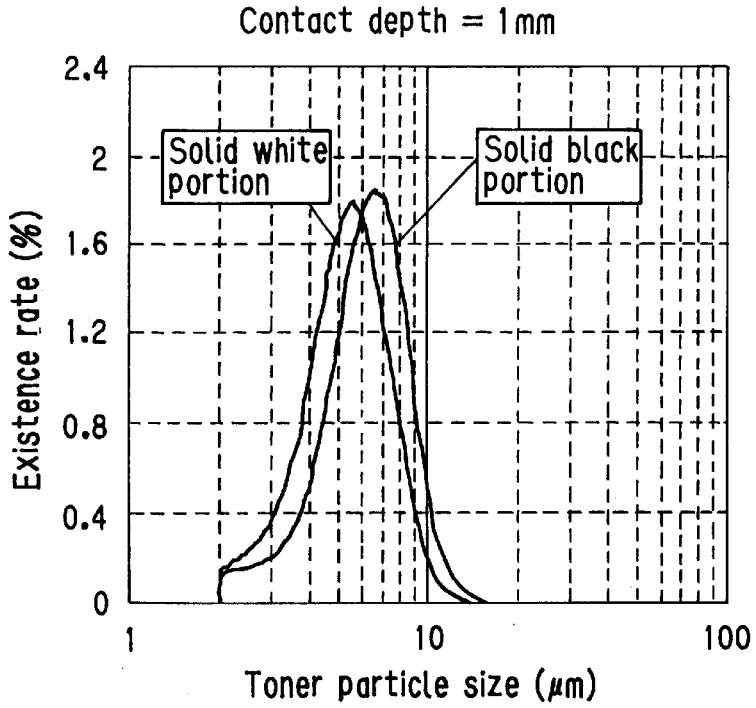

As shown in FIG. 5A, with the contact depth of 0.5 mm, the toner particle size distribution largely differs in the solid black portion and in the solid white portion, while as shown in FIG. 5B, with the contact depth of 1 mm, the difference in the toner particle size distribution is improved. Therefore, it can be understood that the contact depth must be deep to peel off the toner on the developing roller only by the feed roller 200.

Then by changing the foamed cell density from 50/in. to 180/in. for detailed evaluation, it was found that followability of the solid black density can be secured without development history and good results were obtained, at the foamed cell density of from 80/in. to 140/in. and with the contact depth with the developing roller of from 0.5 to 1 mm.

The third embodiment will now be described.

The developing device used in the third embodiment has the same construction as in the first embodiment, and as the discharging member 400, an antistatic film "Bayfol AS-A" having a thickness of 0.2 mm produced by Bayer AG in Germany was used. To the toner feed roller 200, supply bias voltage Et of −200 (V) (with respect to the developing roller) was impressed, and to the discharging member 400, discharging bias voltage Ec of from 0 to +300 (V) (with respect to the developing roller) was impressed, thereby the existence of development memory was examined. Moreover, to examine the effect of scratching the residual toner on the developing roller 100 after being discharged by means of the toner feed roller 200, the following experiment was conducted for evaluation.

To examine the effect of scratching the residual toner with the toner feed roller 200, a manuscript in which a solid white portion and a solid black portion exist half-and-half in the longitudinal direction of an A3 paper is prepared and the test image is printed for 10 sheets of paper continuously. At this time, since the toner on the developing roller 100 has been consumed for every printing in the area of the solid black portion, and new toner 10 has been supplied by the feed roller 200, the particle size distribution of the toner 10 is nearly constant. In the area of the solid white portion, however, the toner 10 is not consumed and passes through the discharging member 400 to return to the feed roller 200. At this time, if the scratching effect after discharging is low, a toner having a small particle size which passes easily through the contact area between the feed roller 200 and the developing roller 100, among residual toner on the developing roller 100, is again transferred to the developing zone.

Accordingly, it can be considered that as the toner particle size distribution in the solid white area approximates to that in the solid black area, the larger the scratching effect in the contact area of the feed roller 200 and the developing roller 100 is obtained.

Figure 6:
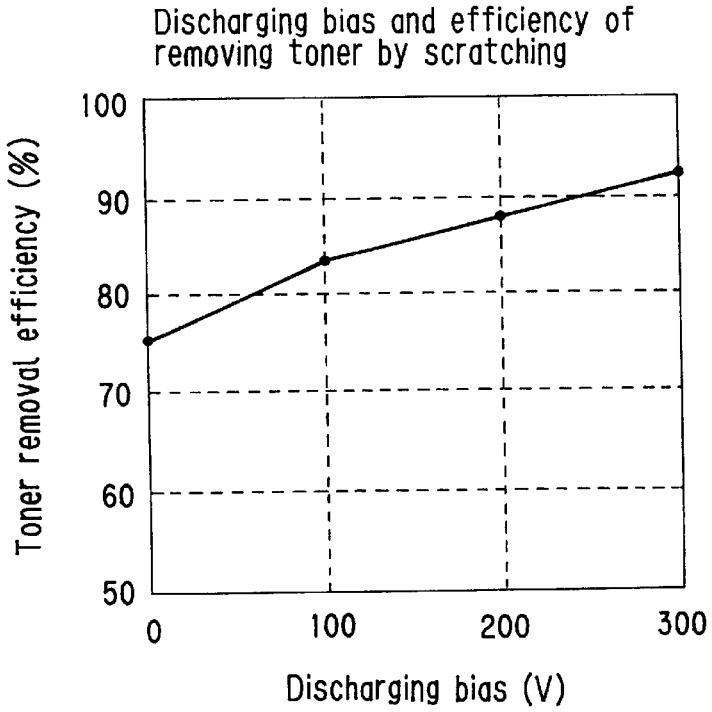
FIG. 6 is a graph showing examples of the impressed voltage of discharging bias and the toner scratching effects on the developing roller according to the third embodiment.

Therefore, after the test image was printed for 10 sheets of paper continuously, the toner 10 on the developing roller 100 was gathered to measure the toner particle size distribution in the solid white portion and the toner particle size distribution in the solid black portion by means of a particle size distribution measuring device (Coulter Multisizer II). FIG. 6 shows the result of calculation of the toner removal rate by applying the discharging bias.

In this case, the toner removal rate was calculated according to the following formula, using a peak value of the toner particle size distribution in the solid black portion and a peak value of the toner particle size distribution in the solid white portion:

$$\text{Removal rate} = 100 - \left\{ \frac{\left(\begin{array}{c}\text{particle size}\\ \text{in solid black}\\ \text{portion}\end{array}\right) - \left(\begin{array}{c}\text{particle size}\\ \text{in solid white}\\ \text{portion}\end{array}\right)}{\left(\begin{array}{c}\text{particle size}\\ \text{in solid black}\\ \text{portion}\end{array}\right) + \left(\begin{array}{c}\text{particle size}\\ \text{in solid white}\\ \text{portion}\end{array}\right)} \right\} \times 100$$

According to FIG. 6, it can be seen that as the impressed voltage of the discharging bias increases, the toner removal rate increases. Therefore, it was found that by applying a discharging bias to the discharging member 400, the effect of removing the residual toner on the developing roller 100 with the feed roller 200 was improved.

The fourth embodiment will now be described.

The developing device 1 used in the fourth embodiment has the same construction as in the first embodiment, and as the toner feed roller, an elastic foamed body having a cell density of 80/in. was used, and evaluation was performed by setting the contact depth with the developing roller to be 1 mm. In addition, as the discharging member, an antistatic film "Bayfol AS-A" having a thickness of 0.2 mm produced by Bayer AG in Germany was used. To the toner feed roller 200, supply bias voltage Et of from 0 to −400 (V) (with respect to the developing roller) was impressed, and to the discharging member, discharging bias voltage Ec of from 0 to +300 (V) (with respect to the developing roller) was impressed, thereby the followability of solid black density and the occurrence of development memory under the conditions for applying each supply bias and discharging bias was evaluated.

In this case, the toner supply followability was evaluated by preparing a solid black image, printing the solid black portion on an A3 paper, and determinating the resulting fluctuation in the optical density.

For an evaluation of a development memory, a test pattern for confirming a development memory, which has a checker pattern in a beginning portion to write the image, and thereafter has an image density of halftone, was prepared. This checker pattern is a square with each side 15 mm long, in which a white portion and a black portion exist alternately. Upon starting printing, checker patterns in three lines were printed, thereafter halftone image having an average optical density of 0.4 (measurement value with Machbeth RD918) was printed, thereby development history was confirmed and evaluated.

Actually, the developing device of this embodiment was incorporated into a laser printer, and a solid black manuscript or a test pattern for confirming a development memory was printed on an A3 paper using the laser printer.

Figure 7:
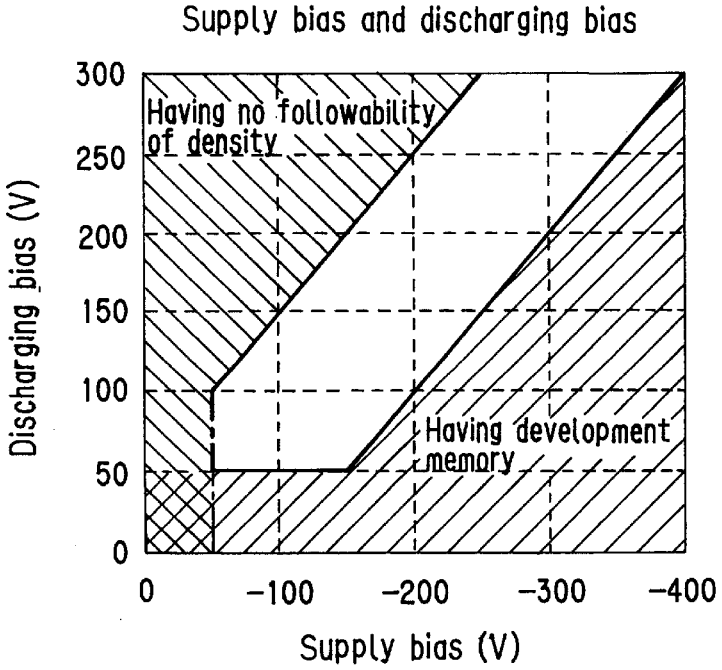
FIG. 7 is a graph showing the relation between the impressed voltage of the supply bias and the discharging bias and the presence/absence of the development memory according to the fourth embodiment.

FIG. 7 shows a result of existence of development memory and the followability of solid black density due to the supply bias and discharging bias. As shown in FIG. 7, when the supply bias is 0 (V), that is, the same potential as that of the developing roller, the followability of the solid black density cannot be obtained. In addition, when the discharging bias is 0 (V), that is, the same potential as that of the developing roller, discharging effect cannot be obtained, and under a condition that the supply bias of from 0 to −400 (V) is applied, development memory cannot be removed. From a level of discharging bias of +100 (V) or higher, removal of the development memory becomes possible. However, at the time of applying supply bias of −50 (V), the supply capability decreased and the image density of solid black slightly decreased. While changing voltage for applying supply bias and discharging bias, the above-mentioned image for evaluation was output to obtain a range where excellent images can be obtained, and it was found that good images could be obtained if the following conditions were satisfied:

$$|Vc|-50 \leqq |Vt| \leqq |Vc|+100 \text{ (V)}.$$

The fifth embodiment will now be described.

Figure 8:
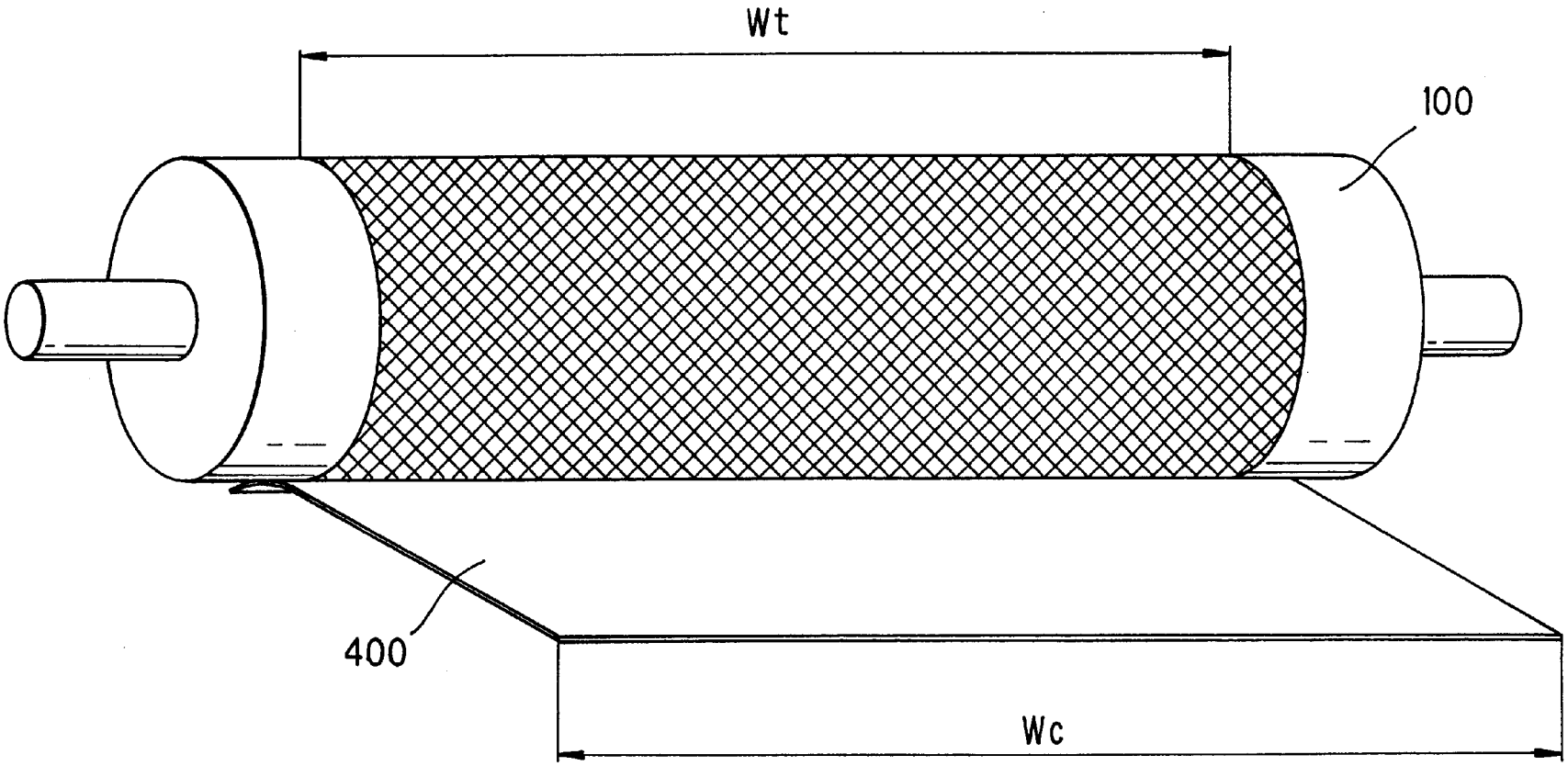
FIG. 8 is a perspective view of the developing roller according to the fifth embodiment.

FIG. 8 is a detailed perspective view of the developing roller 100 and the discharging member 400. The entire toner on the developing roller 100 can be discharged by designing the widthwise length Wc of the discharging member 400 to be slightly longer than the width of toner transfer area Wt on the developing roller 100.

As described above, according to the invention of the first gist, since an elastic member is provided on a surface opposite to the abutting surface of the discharging member and the developing roller, in a contact area of the discharging member and the developing roller, it becomes possible to enlarge the contact area thereof without increasing the contact pressure between the developing roller and the discharging member due to the abutment of the discharging member with the developing roller. Moreover, the time when the residual toner on the developing roller comes in contact with the discharging member becomes long to enhance the effect of discharging the toner, and the scratching effect of the toner with the feed roller is also improved, hence an image without causing any development history can be obtained.

According to the invention of the second gist, by setting the hardness of the elastic member to be not higher than 70° measured by Asker F hardness, an effect to enlarge the area contacting with the developing roller can be easily obtained.

According to the invention of the third gist, by defining a range of the foamed cell density of the feed roller, deterioration of the feed capability, such as blocking of toner can be prevented. Moreover, by limiting the contact depth, increase of torque for driving the feed roller is suppressed, and stable supply of toner and removal capability can be maintained even after the lapse of time.

According to the invention of the fourth gist, by satisfying the toner removal condition and the toner feed condition of the feed member, an image without density unevenness and development history can be obtained.

According to the invention of the fifth gist, by using an electroconductive sponge material for the feed member and impressing bias voltage of the same polarity as the toner charging characteristic to the feed member, toner can be supplied stably and sufficiently, and stable followability of density can be obtained even for images with large consumption of toner, such as solid black portions and the like.

According to the invention of the sixth gist, by using the impressed voltages of the supply bias and the discharging bias in the respective ranges defined in the present invention, the residual toner on the developing roller can be satisfactorily discharged and further, toner can be stably supplied due to the supply bias. As a result, development history is not caused and density followability is also secured.

According to the invention of the seventh gist, by using a thin-plate electroconductive material for the discharging member, a discharging bias having a polarity opposite to the charging polarity of the toner can be applied at the contact area of the developing roller and the discharging member, and therefore, electric adherence of the developing roller and the residual toner adhered on the surface of the developing roller can be reduced.

According to the invention of the eighth gist, by using a thin plate material comprising polycarbonate, polybutyl terephthalate and carbon for the discharging member, the wear resistance of the discharging member is improved, thereby there is obtained an effect that deterioration of the discharging capability is not caused, even if it is used for a long period of time.

According to the invention of the ninth gist, by bringing the discharging member into contact with the developing roller, the discharging member being longer than the toner adhering area on the developing roller in the axial direction of the developing roller, the entire toner on the developing roller passes through the contact area of the discharging member and the developing roller, hence there is an effect that the entire toner on the developing roller can be discharged after passing through the developing zone.

What is claimed is:

1. An electrostatic latent image developing device comprising: a developer carrier for supporting and carrying one-component developer on the surface thereof; a developer feed member for abutting against the developer carrier and feeding the developer to the developer carrier; and a discharging member for discharging the developer on the developer carrier after development, in which residual developer on the developer carrier is removed, wherein an elastic member for pressing is provided in a prescribed location in an area where the developer carrier comes in contact with the discharging member, in order to bring the discharging member into contact with the developer carrier so that mechanical peeling of the residual developer on the developer carrier is not caused, the discharging member is provided with a bias power supply for setting bias in a direction imparting to the discharging member a force for electrically drawing the residual developer on the developer carrier away from the developer carrier, and after thus reducing the electric adhesion of the residual developer to the developer carrier, the developer feed member removes the residual developer on the developer carrier in the vicinity of disjunction area or in the contact area of the developer carrier and the developer feed member, and thereafter applies new developer in a developer container to the developer carrier in the vicinity of approaching area or in the contact-starting area of the developer carrier and the developer feed member.

2. A developing device according to claim 1, wherein the elastic member for pressing has the Asker F hardness of not higher than 70°.

3. A developing device according to claim 1, wherein the developer feed member comprises an elastic foamed body having the number of foaming cells of from 80/in. to 140/in., said developer feed member abuts against the developer carrier with a contact depth of from 0.5 mm to 1 mm, feeds the developer to the developer carrier in proximity to or in the contact area with the developer carrier, and removes the residual toner on the developer carrier in the disjunction or contact area thereof.

4. A developing device according to claim 1, wherein the developer feed member comprises an elastic foamed body having the Asker F hardness of 60° to the Asker C hardness of 30°.

5. A developing device according to claim 1, wherein the developer feed member is an electroconductive elastic foamed body having a resistance of from $10^4$ to $10^7$ (Ω), and bias voltage of the same polarity as the charging polarity of the developer on the developer carrier is applied to said developer feed member.

6. A developing device according to claim 1, wherein the following formula is satisfied:

$$|Vc|-50 \leqq |Vt| \leqq |Vc|+100 \text{ (V)}$$

with regard to the bias voltage Vt (V) impressed to the developer feed member and the bias voltage Vc (V) impressed to the discharging member.

7. A developing device according to claim 1, wherein the discharging member is a thin plate-like member of an electroconductive elastic body, and bias voltage having a polarity opposite to the charging polarity of the developer is impressed to the discharging member.

8. A developing device according to claim 7, wherein the discharging member in the thin plate-like member comprises polycarbonate, polybutyl terephthalate, and carbon black, the discharging member having a resistance value from $10^3$ to $10^6$ (Ω).

9. A developing device according to claim 1, wherein the discharging member and the developer carrier abut against each other in the contact area in the axial direction wider than the developer carrying area on the developer carrier.

* * * * *